US010964257B2

(12) United States Patent
Kim

(10) Patent No.: US 10,964,257 B2
(45) Date of Patent: Mar. 30, 2021

(54) DISPLAY DEVICE

(71) Applicant: SAMSUNG ELECTRONICS CO., LTD., Suwon-si (KR)

(72) Inventor: Jungmoon Kim, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 0 days.

(21) Appl. No.: 16/774,319

(22) Filed: Jan. 28, 2020

(65) Prior Publication Data

US 2020/0372859 A1 Nov. 26, 2020

(30) Foreign Application Priority Data

May 22, 2019 (KR) ..... 10-2019-0060138

(51) Int. Cl.
*G09G 3/3225* (2016.01)
*G09G 3/3275* (2016.01)

(52) U.S. Cl.
CPC ..... *G09G 3/3225* (2013.01); *G09G 3/3275* (2013.01); *G09G 2310/0297* (2013.01); *G09G 2310/08* (2013.01); *G09G 2320/0233* (2013.01); *G09G 2320/0626* (2013.01); *G09G 2360/147* (2013.01)

(58) Field of Classification Search
CPC ..... G09G 2320/043; G09G 2320/045; G09G 2320/0295; G09G 2320/0233; G09G 2320/0285; G09G 2320/046; G09G 2320/048
See application file for complete search history.

(56) References Cited

U.S. PATENT DOCUMENTS 7,079,091 B2 * 7/2006 Kondakov ..... G09G 3/3208 345/214
8,274,503 B2 9/2012 Kwon
8,294,696 B2 * 10/2012 Min ..... G09G 3/3291 345/204
9,047,812 B2 * 6/2015 Chun ..... G09G 3/3208
9,219,908 B2 * 12/2015 Kim ..... H04N 13/359
9,224,332 B2 * 12/2015 Byun ..... G09G 3/3233
9,230,472 B2 * 1/2016 Bae ..... G09G 3/3208
(Continued)

FOREIGN PATENT DOCUMENTS

KR 10-2014-0077789 A 6/2014
KR 10-1548495 B1 9/2015
(Continued)

*Primary Examiner* — Michael J Jansen, II
(74) *Attorney, Agent, or Firm* — Lee IP Law, PC

(57) ABSTRACT

A display device includes a display panel including pixels arranged in rows and columns, a gate driver connected to pixels in the rows through first gate lines and second gate lines, a data driver connected to the pixels in the columns through data lines, a sensor connected to the pixels in the columns through sensing lines, a memory to store a look-up table, and a timing controller to control the gate driver and the data driver to adjust the brightnesses of the pixels through the first gate lines and the data lines and to control the gate driver and the sensor to perform a sensing operation of sensing the brightnesses of the pixels through the second gate lines and the sensing lines. The timing controller reads the look-up table from the memory and adjusts a sensing period of the sensing operation based on the look-up table.

18 Claims, 10 Drawing Sheets

(56) References Cited

U.S. PATENT DOCUMENTS

| | | | | |
|---|---|---|---|---|
| 9,396,675 | B2 | 7/2016 | Kim et al. | |
| 9,401,110 | B2 * | 7/2016 | Lee | G09G 3/3208 |
| 9,685,119 | B2 * | 6/2017 | Kim | G09G 3/006 |
| 9,830,851 | B2 * | 11/2017 | Zhuang | G06T 1/20 |
| 9,870,731 | B2 * | 1/2018 | Jiang | G09G 3/3208 |
| 9,922,598 | B2 | 3/2018 | Park et al. | |
| 10,163,401 | B2 * | 12/2018 | Chaji | G09G 3/3291 |
| 10,388,225 | B2 * | 8/2019 | Pyeon | G09G 3/3233 |
| 10,621,913 | B2 * | 4/2020 | Furukawa | G09G 3/3233 |
| 2004/0135749 | A1 * | 7/2004 | Kondakov | G09G 3/3208 345/82 |
| 2010/0073335 | A1 * | 3/2010 | Min | G09G 3/3233 345/204 |
| 2012/0050280 | A1 * | 3/2012 | Kim | G09G 3/3648 345/419 |
| 2013/0083087 | A1 * | 4/2013 | Byun | G09G 3/3233 345/690 |
| 2013/0147693 | A1 * | 6/2013 | Bae | G09G 3/3225 345/82 |
| 2014/0118426 | A1 * | 5/2014 | Chun | G09G 3/3208 345/691 |
| 2014/0160142 | A1 * | 6/2014 | Lee | G09G 3/3208 345/589 |
| 2015/0379937 | A1 * | 12/2015 | Kim | G09G 3/3291 345/691 |
| 2016/0063925 | A1 | 3/2016 | Bae et al. | |
| 2016/0307498 | A1 * | 10/2016 | Chaji | G09G 3/3291 |
| 2016/0343302 | A1 * | 11/2016 | Han | G09G 3/3233 |
| 2016/0379550 | A1 * | 12/2016 | Jiang | G09G 3/3208 345/520 |
| 2016/0379551 | A1 * | 12/2016 | Zhuang | G09G 3/3208 345/520 |
| 2018/0096655 | A1 * | 4/2018 | Pyeon | G09G 3/3233 |
| 2018/0366061 | A1 * | 12/2018 | Furukawa | G09G 3/3233 |
| 2020/0202779 | A1 * | 6/2020 | Chang | G09G 3/3233 |

FOREIGN PATENT DOCUMENTS

| | | | |
|---|---|---|---|
| KR | 10-2017-0081043 | A | 7/2017 |
| KR | 10-2019-0007662 | A | 1/2019 |

* cited by examiner

DISPLAY DEVICE

CROSS-REFERENCE TO RELATED APPLICATION

Korean Patent Application No. 10-2019-0060138, filed on May 22, 2019, in the Korean Intellectual Property Office, and entitled: "Display Device," is incorporated by reference herein in its entirety.

BACKGROUND

1. Field

Embodiments relate to a semiconductor device, and more particularly, relate to a display device that adjusts a time parameter associated with a sensing operation for sensing brightnesses of pixels to reduce power consumption in the sensing operation.

2. Description of the Related Art

An organic light-emitting diode (OLED) device has been developed as one of light-emitting devices. Because the OLED device has a spontaneous light-emitting characteristic, the OLED device does not require an additional component for light-emitting, e.g., a backlight unit. Thus, a display device with the OLED device has been researched and developed.

A display panel with the OLED device may include pixels that are arranged in rows and columns. Each pixel may include an organic light-emitting diode and a transistor. The transistor may adjust brightness of the organic light-emitting diode by adjusting an amount of current flowing through the organic light-emitting diode.

The transistor and the organic light-emitting diode of each pixel may be degraded as operating time goes by. When the transistor and the organic light-emitting diode are degraded, the amount of current flowing through the organic light-emitting diode may change, and thus, the brightness of each pixel may differ from a target brightness. Thus, the display device has adopted a sensing operation for measuring a degradation degree of the pixel and a compensation operation for compensating the degradation degree of the pixel.

SUMMARY

Embodiments are directed to a display device. The display device may include a display panel including pixels arranged in rows and columns; a gate driver connected to the pixels in the rows through first gate lines and second gate lines; a data driver connected to the pixels in the columns through data lines; a sensor connected to the pixels in the columns through sensing lines; a memory to store a look-up table including information of brightnesses of the pixels; and a timing controller to control the gate driver and the data driver to adjust the brightnesses of the pixels through the first gate lines and the data lines and to control the gate driver and the sensor to perform a sensing operation for sensing the brightnesses of the pixels through the second gate lines and the sensing lines. The timing controller may read the look-up table from the memory and adjust a sensing period of the sensing operation based on the look-up table.

Embodiments are directed to a display device. The display device may include a display panel including pixels arranged in rows and columns; a gate driver connected to the pixels in the rows through first gate lines and second gate lines; a data driver connected to the pixels in the columns through data lines; a sensor connected to the pixels in the columns through sensing lines; and a timing controller to control the gate driver and the data driver to control brightnesses of the pixels through the first gate lines and the data lines and to control the gate driver and the sensor to perform a sensing operation for sensing the brightnesses of the pixels through the second gate lines and the sensing lines. The timing controller may receive a sensing result of the sensing operation from the sensor, detect degradation speeds of the pixels based on the sensing result, set similar degradation pixels, which have similar degradation speeds, from among the pixels to a pixel group, and select one pixel from the similar degradation pixels belonging to the pixel group in the sensing operation. The timing controller may sense a brightness of the selected one pixel, detect a degradation speed of the selected one pixel, and determine the degradation speed as the similar degradation speeds of the similar degradation pixels.

Embodiments are directed to a display device. The display device may include a display panel including pixels arranged in rows and columns; a gate driver connected to the pixels in the rows through first gate lines and second gate lines; a data driver connected to the pixels in the columns through data lines; a sensor connected to the pixels in the columns through sensing lines; and a timing controller to control the gate driver and the data driver to adjust brightnesses of the pixels through the first gate lines and the data lines and to control the gate driver and the sensor to perform a sensing operation for sensing the brightnesses of the pixels through the second gate lines and the sensing lines. The timing controller may adjust a transfer time when voltages are transferred from pixels in each of the rows of the pixels to the sensing lines in the sensing operation.

BRIEF DESCRIPTION OF THE DRAWINGS

Features will become apparent to those of skill in the art by describing in detail exemplary embodiments with reference to the attached drawings in which.

DETAILED DESCRIPTION

Figure 1:
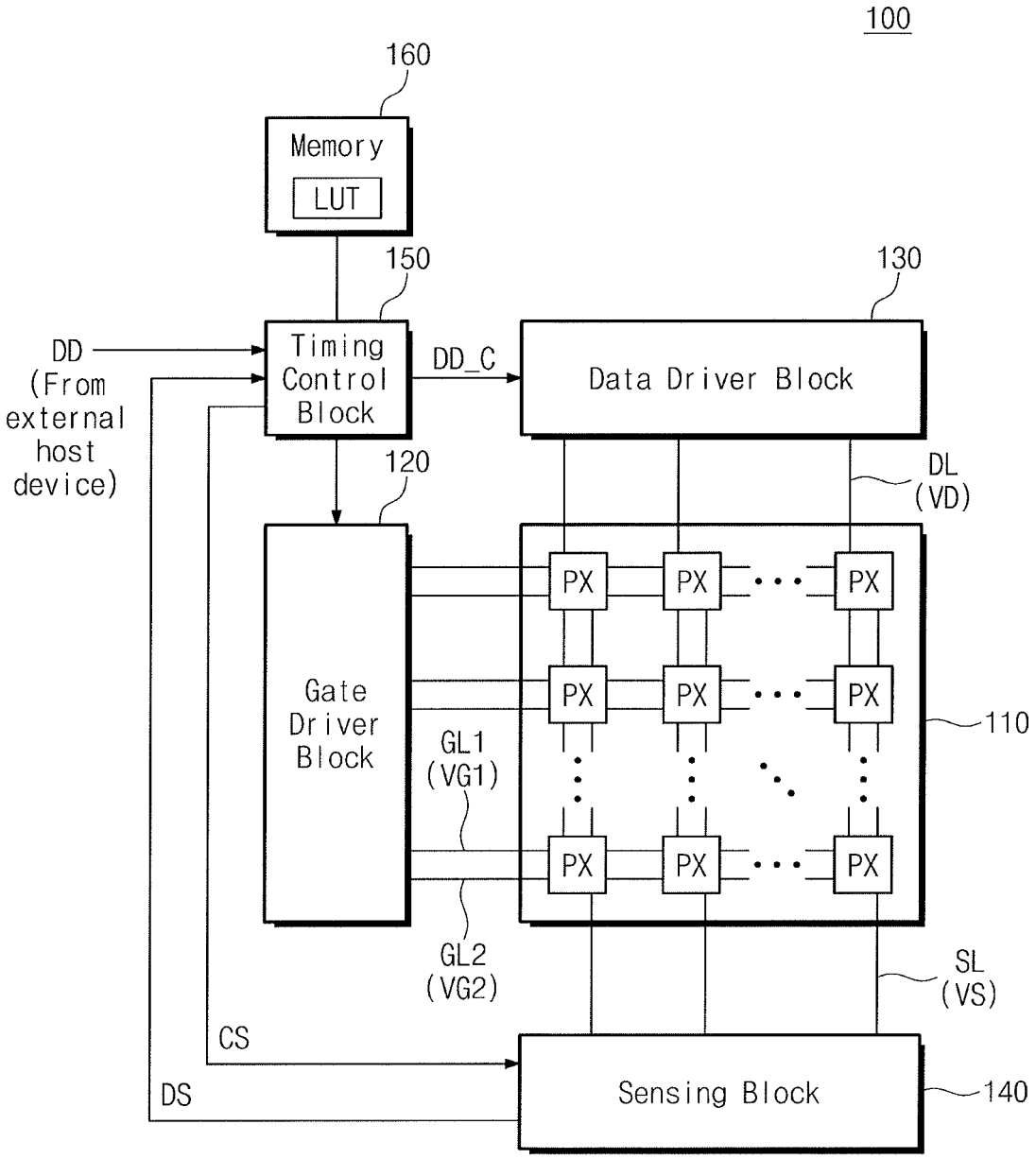
FIG. 1 illustrates a display device according to an example embodiment.

FIG. 1 illustrates a display device 100 according to an example embodiment. Referring to FIG. 1, the display device 100 may include a display panel 110, a gate driver 120, a data driver 130, a sensor 140, a timing controller 150, and a memory 160.

The display panel 110 may include a plurality of pixels PX. The plurality of pixels PX may be arranged in rows and columns. The plurality of pixels PX may be connected to the gate driver 120 and the data driver 130 through first and second gate lines GL1 and GL2, data lines DL, and sensing lines SL. For example, the pixels PX in each row may be connected to the gate driver 120 through a corresponding first gate line GL1 and a corresponding second gate line GL2. The pixels in each column may be connected to the data driver 130 through a corresponding data line DL and may be connected to the sensor 140 through a corresponding sensing line SL.

The pixels PX in each row may be selected for displaying an image, through the corresponding first gate line GL1. The pixels PX selected for displaying the image may receive a current or a voltage supplied from the data driver 130 through the data lines DL. Further, brightnesses of the pixels PX may be adjusted according to the current or the voltage from the data driver 130. The pixels PX may display the image by adjusting the brightnesses of the pixels PX.

For example, the pixels PX in each row may be selected for a sensing operation through the second gate line GL2. The pixels PX selected for the sensing operation may output current information corresponding to the brightnesses of the pixels PX through the sensing lines SL.

The gate driver 120 may be connected to the pixels PX through the first gate lines GL1 and the second gate lines GL2. For example, the gate driver 120 may be connected to the pixels PX in one row through the corresponding first and second gate lines GL1 and GL2.

The gate driver 120 may adjust first gate voltages VG1 of the first gate lines GL1 and second gate voltages VG2 of the second gate lines GL2 in response to a control signal output from the timing controller 150. For example, under control of the timing controller 150, the gate driver 120 may adjust the first gate voltages VG1 to have a first turn-on voltage and a first turn-off voltage.

For example, the gate driver 120 may adjust the first gate voltage VG1 of a target first gate lines GL1 to have the first turn-on voltage in response to the control signal output from the timing controller 150. The first turn-on voltage may be used to select pixels PX in a target row for display the image. Further, the gate driver 120 may adjust the first gate voltages VG1 of the remaining first gate lines GL1 to have the first turn-off voltage in response to the control signal output from the timing controller 150. The first turn-off voltage may be used to set pixels PX in the remaining rows to be a non-selection state. Under control of the timing controller 150, the gate driver 120 may select the first gate lines GL1 sequentially during a time period corresponding to one frame of display data DD.

For example, under control of the timing controller 150, the gate driver 120 may adjust the second gate voltages VG2 to have a second turn-on voltage and a second turn-off voltage. The gate driver 120 may adjust the second gate voltage VG2 of a target second gate line GL2 to have the second turn-on voltage. The second turn-on voltage may be used to select pixels in a target row for the sensing operation. Under control of the timing controller 150, the gate driver 120 may adjust the second gate voltages VG2 of the remaining second gate lines GL2 to have the second turn-off voltage. The second turn-off voltage may be used to set pixels in the remaining rows to be a non-selection state for the sensing operation. Under control of the timing controller 150, for the sensing operation, the gate driver 120 may select one or more second gate lines GL2 sequentially during a time period corresponding to one frame of the display data DD.

The data driver 130 may be connected to the pixels PX through the data lines DL. For example, the data driver 130 may be connected to the pixels PX in one column through the corresponding data line DL. The data driver 130 may receive calibrated display data DD_C from the timing controller 150.

The data driver 130 may apply data voltages VD corresponding to the calibrated display data DD_C to the data lines DL. The data driver 130 may adjust brightnesses of the pixels PX in a selected row according to the data voltages VD.

The sensor 140 may be connected to the pixels PX through the sensing lines SL. For example, the sensor 140 may be connected to the pixels PX in one column through one sensing line SL. The sensor 140 may receive a control signal CS from the timing controller 150 and receive sensing voltages VS from the pixels PX in the selected row through the sensing lines SL. The sensor 140 may digitize the sensing voltages VS to generate sensing data DS. The sensor 140 may provide the sensing data DS to the timing controller 150.

The timing controller 150 may receive the display data DD from an external host device, e.g., an application processor (AP) or a graphics processing unit (GPU). The timing controller 150 may control the gate driver 120 to sequentially select pixels PX in each row.

The timing controller 150 may select data corresponding to the pixels PX in the selected row from the display data DD and calibrate the selected data based on degradation degrees of the pixels PX in the selected row. The timing controller 150 may generate the calibrated display data DD_C based on the calibrated data corresponding the pixels PX in each row. The timing controller 150 may adjust brightnesses of the pixels PX in the selected row based on the calibrated display data DD_C by transmitting the calibrated display data DD_C to the data driver 130.

The timing controller 150 may perform the sensing operation for sensing the degradation degrees of the pixels PX in the display panel 110. For example, in the sensing operation, the timing controller 150 may control the sensor 140 to detect the brightnesses of the pixels PX. The timing controller 150 may receive the detected brightnesses of the pixels PX as the sensing data DS from the sensor 140.

The timing controller 150 may compare original brightnesses indicated by the calibrated display data DD_C and actual brightnesses detected by the sensor 140. For example, the actual brightnesses may be indicated by the sensing data DS. The timing controller 150 may calculate brightness differences between the original brightnesses and the actual brightnesses and determine the calculated brightness differences as the degradation degrees of the pixels.

The timing controller 150 may perform the sensing operation on the pixels PX for two or more frames. For example, the timing controller 150 may divide the pixels PX into two or more groups by grouping columns of the pixels PX. The timing controller 150 may perform the sensing operation on one of the two or more groups after the calibrated display data DD_C of one frame are transmitted to the pixels PX. For example, the timing controller 150 may perform the sensing operation on one of the two or more groups when the pixels display the image using the calibrated display data DD_C.

The timing controller 150 may further perform a compensation operation. The compensation operation may refer to an operation for compensating levels (e.g., brightness values) based on the sensed degradation degrees of pixels. For example, the compensation operation may include calibrating the display data DD to generate the calibrated display data DD_C. For example, the compensation operation may be performed after the sensing operation is completely performed on all the pixels PX.

The memory 160 may include a nonvolatile memory device, e.g., a programmable read only memory (PROM), an electrically programmable ROM (EPROM), an electrically erasable and programmable ROM (EEPROM), a phase-change RAM (PRAM), a magnetic RAM (MRAM), a resistive RAM (RRAM), or a ferroelectric RAM (FRAM). The memory 160 may store a look-up table LUT. The look-up table LUT may include information of a degradation characteristic of the pixels PX. The look-up table LUT may be used for performing the sensing operation and the compensation operation, which are controlled by the timing controller 150.

The timing controller 150 may periodically perform the sensing operation or the compensation operation. For example, when a power is supplied to the display device 100, the sensing operation or the compensation operation may be repeatedly performed. Thus, the sensing operation or the compensation operation may be a main cause of an increase in power consumption of the display device 100. For example, as the sensing operation or the compensation operation is more frequently performed, the power consumption of the display device 100 may be increased.

The display device 100 according to an example embodiment may adjust a period of the sensing operation or the compensation operation to reduce the power consumption of the display device 100. For example, the timing controller 150 may read the look-up table LUT from the memory 160 and adjust the period of the sensing operation or the compensation operation based on the look-up table LUT to reduce the power consumption of the display device 100.

In an example embodiment, the gate driver 120, the data driver 130, the sensor 140, the timing controller 150, and the memory 160 may be implemented in one integrated circuit (e.g., a mobile display driver integrated circuit (DDI)). For another example, the gate driver 120, the data driver 130, and the sensor 140 may be implemented in one integrated circuit. For example, the timing controller 150 and the memory 160 may be implemented in another integrated circuit.

Figure 2:
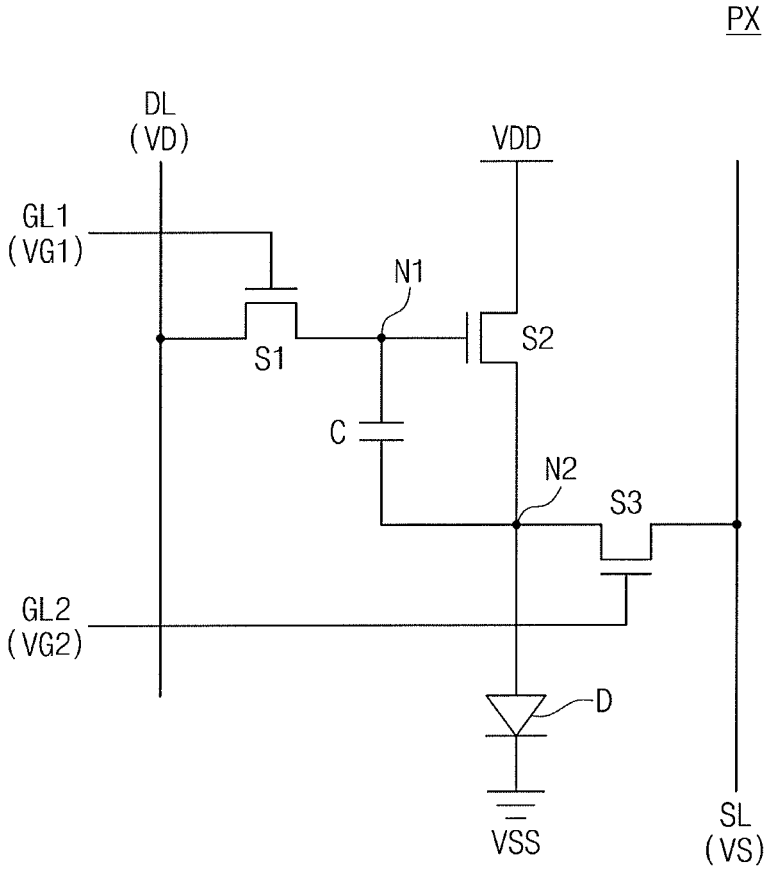
FIG. 2 illustrates a circuit of a pixel according to an example embodiment.

FIG. 2 illustrates a pixel PX according to an example embodiment. Referring to FIGS. 1 and 2, the pixel PX may include first to third switches S1 to S3, a capacitor "C", and a diode "D".

The first switch S1 may be connected between the data line DL and a first node N1. The first switch S1 may operate in response to the first gate voltage VG1 of the first gate line GL1. When the first gate voltage VG1 is the first turn-on voltage, the first switch S1 may transfer the data voltage VD of the data line DL to the first node N1.

The second switch S2 may be connected between a second node N2 and a power node for receiving a power supply voltage VDD. The second switch S2 may operate in response to a voltage of the first node N1. The capacitor "C" may be connected between the first node N1 and the second node N2. When the first gate voltage VG1 is the first turn-on voltage, the capacitor "C" may maintain a voltage difference between the first node N1 and the second node N2 to be constant. For example, the capacitor "C" may store a voltage corresponding to the data voltage VD. The second switch S2 may control a current corresponding to the data voltage VD to flow from the power node to the second node N2.

The diode "D" may be connected between the second node N2 and a ground node for receiving a ground voltage VSS. The diode "D" may receive the current corresponding to the data voltage VD from the second node N2. The diode "D" may be, e.g., an organic light-emitting diode (OLED). The diode "D" may emit a light with brightness that is proportional to a current flowing therethrough.

The third switch S3 may be connected between the second node N2 and the sensing line SL. The third switch S3 may operate in response to the second gate voltage VG2 of the second gate line GL2. When the second gate voltage VG2 is the second turn-on voltage, the third switch S3 may transfer a voltage of the second node N2, which is proportional to a current flowing through the second node N2, to the sensing line SL as the sensing voltage VS.

In an example embodiment, the first to third switches S1 to S3 may be implemented with NMOS transistors. Alternatively, the first to third switches S1 to S3 may be implemented with PMOS transistors. Further, the pixel PX illustrated in FIG. 2 may be configured in various circuits.

Figure 3:
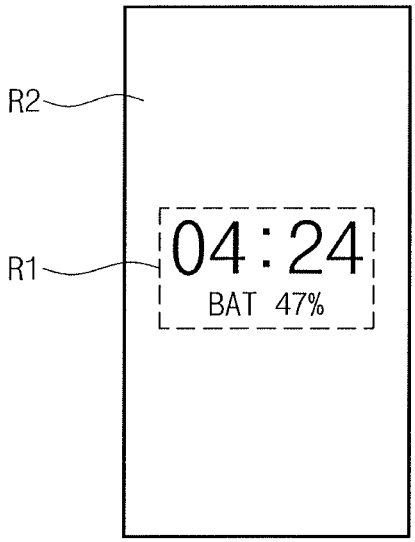
FIG. 3 illustrates an example of an image displayed by a display device.

FIG. 3 illustrates an example of an image displayed by the display device 100. Referring to FIGS. 1 and 3, the display device 100 may display a time and a battery charge percentage indicating a level (e.g., 47%) of a battery (BAT) in a first region R1 and may not display any information in a second region R2. When an image is displayed as illustrated in FIG. 3, the degradation degrees of pixels PX in the first region R1 may be higher than the degradation degrees of pixels PX in the second region R2.

Figure 4:
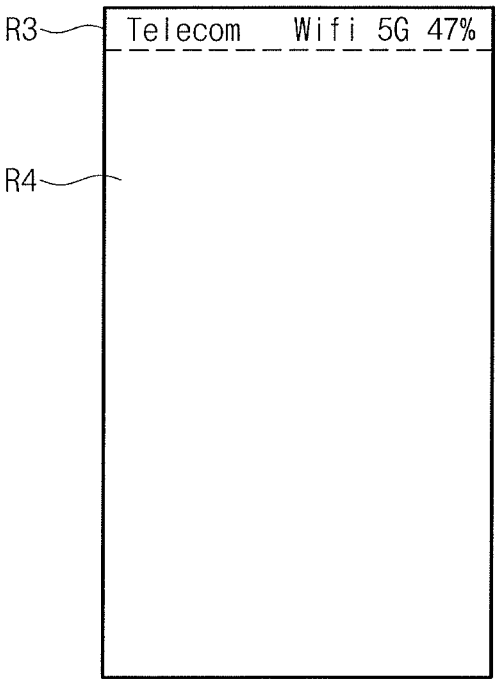
FIG. 4 illustrates another example of an image displayed by a display device.

FIG. 4 illustrates another example of an image displayed by the display device 100. Referring to FIGS. 1 and 4, in an active mode, the display device 100 may display an operator (e.g., Telecom), a wireless LAN (e.g., WiFi), a wireless communication network (e.g., 5G), and a charge level (e.g., 47%) of a battery in a third region R3 and may display an application being currently executed in a fourth region R4. When an image is displayed as illustrated in FIG. 4, the degradation degrees of pixels PX in the third region R3 may be uniform, and the degradation degrees of pixels PX in the fourth region R4 may be changed according to whether any application is executed.

As described with reference to FIGS. 3 and 4, the degradation degrees of the pixels PX may be different from respective locations of the pixels PX according to whether the display device 100 displays an image in a low-power mode or in an active mode or according to kinds of images generated by the executed application in the active mode.

Figure 5:
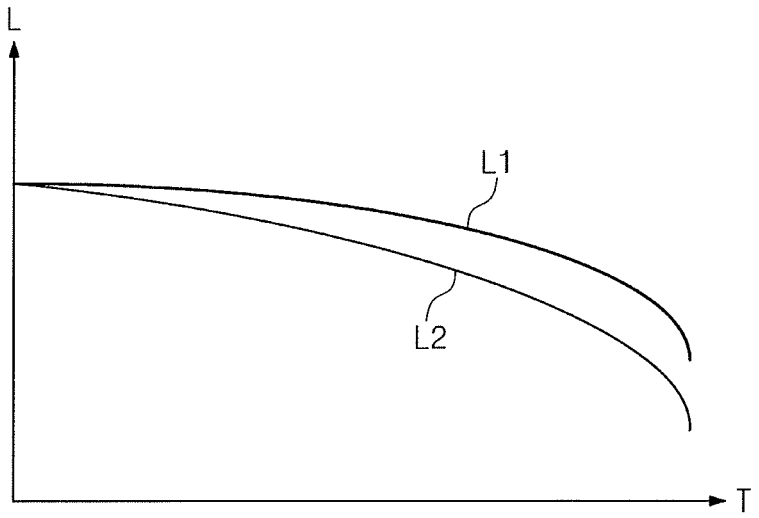
FIG. 5 illustrates different degradation degrees of pixels.

FIG. 5 illustrates another example of different degradation degrees of the pixels PX. Referring to FIG. 5, a horizontal axis represents a time "T", and a vertical axis represents a brightness "L" of a pixel. Referring to FIGS. 1, 3, 4, and 5, a part of the pixels PX may have the degradation degrees (or degradation speeds) corresponding to a first line L1, and at least another part of the remaining pixels of the pixels PX may have the degradation degrees (or degradation speeds) corresponding to a second line L2.

In an example embodiment, a ratio of the low-power mode and the active mode and usage ratios of main applications that are dominantly used in the active mode may be gathered as statistics according to characteristics, e.g., a nationality, a sex, and an age of a user. For example, the degradation degrees in locations (e.g., location domains) of the pixels PX according to the low-power mode, the active mode, and the main applications dominantly used in the active mode, may be provided as a degradation profile of the pixels PX.

The look-up table LUT of the memory 160 may include the degradation profile according to the locations of the pixels PX. The timing controller 150 may adjust a period of the sensing operation or the compensation operation of the pixels PX based on the degradation profile to reduce the power consumption of the display device 100.

In an example embodiment, FIG. 5 illustrates an example of the pixels PX with the degradation degrees corresponding to the first line L1 and the second line L2. Further, the degradation degrees of the pixels PX may have different curves from the first and second lines L1 and L2.

Figure 6:
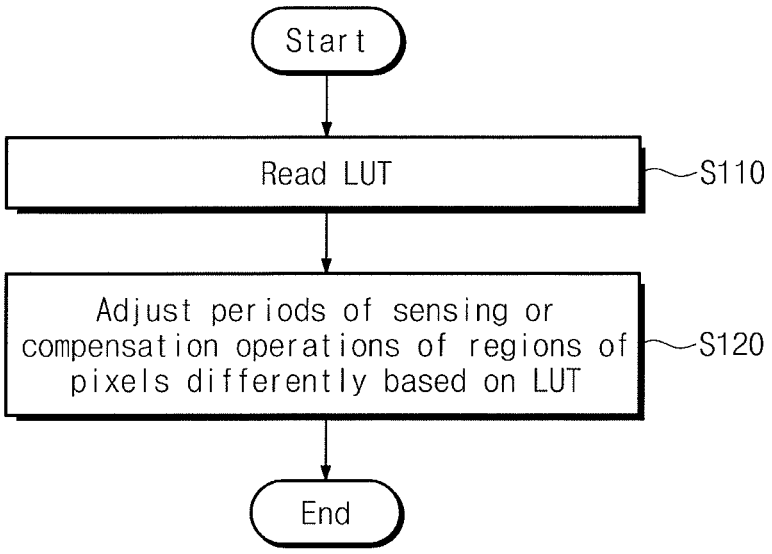
FIG. 6 illustrates a first example in which a timing controller adjusts a sensing period or a compensation period.

FIG. 6 illustrates a first example in which the timing controller 150 adjusts a period of a sensing operation (e.g., a sensing period) or a period of a compensation operation (e.g., a compensation period) with regard to the pixels PX. Referring to FIGS. 1 and 6, in operation S110, the timing controller 150 may read the look-up table LUT from the memory 160. For example, the timing controller 150 may adjust an operating cycle of the sensing operation or the compensation operation. For example, the timing controller 150 may control the number of the sensing operation or the compensation operation during a constant time.

In operation S120, the timing controller 150 may differently adjust the the sensing period or the compensation period with regard to regions of pixels based on the look-up table LUT. For example, as described with reference to FIG. 3, the timing controller 150 may differently adjust sensing periods of the first region R1 and the second region R2. The timing controller 150 may adjust the sensing periods of the sensing operations associated with the first and second regions R1 and R2 such that the sensing period of the sensing operation associated with the second region R2 is greater than the sensing period of the sensing operation associated with the first region R1. For example, the timing controller 150 may adjust sensing cycles of the sensing operations associated with the first and second regions R1 and R2 such that the sensing cycle of the sensing operation associated with the second region R2 is smaller than the sensing cycle of the sensing operation associated with the first region R1.

For example, as described with reference to FIG. 4, the timing controller 150 may differently adjust sensing periods of the sensing operations of the third region R3 and the fourth region R4. The timing controller 150 may adjust the sensing periods of the sensing operations associated with the third and fourth regions R3 and R4 such that the sensing period of the sensing operation associated with the fourth region R4 is greater than the sensing period of the sensing operation associated with the third region R3. For example, the timing controller 150 may adjust sensing cycles of the sensing operations associated with the third and fourth regions R3 and R4 such that the sensing cycle of the sensing operation associated with the fourth region R4 is smaller than the sensing cycle of the sensing operation associated with the third region R3.

As a sensing period of pixels in a particular region increases, a period of the compensation operation may be increased. As the sensing period or the compensation period for the pixels in the particular region increases to be greater than a default value, the power consumption of the display device 100 may be reduced. For example, as a sensing cycle of pixels in the particular region decreases, a compensation cycle of the compensation operation may be decreased. As the sensing cycle or the compensation cycle for the pixels in the particular region decreases to be smaller than a default value, the power consumption of the display device 100 may be reduced.

For another example, the look-up table LUT may include the location-based degradation degrees of the pixels PX according to a power saving mode and kinds of applications. The timing controller 150 may receive additional information from an external host device together with the display data DD. The additional information may include information of the low-power mode or information of an application generating the display data DD in the active mode. The timing controller 150 may adjust sensing periods and compensation periods according to locations of the pixels PX, based on the look-up table LUT and the additional information.

Figure 7:
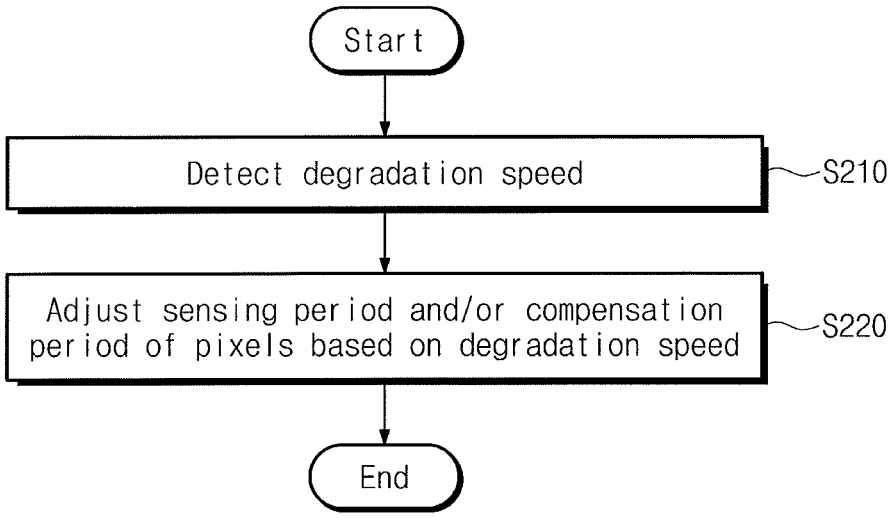
FIG. 7 illustrates a second example in which a timing controller adjusts a sensing period or a compensation period.

FIG. 7 illustrates a second example in which the timing controller 150 adjusts a sensing period or a compensation period. Referring to FIGS. 1 and 7, the timing controller 150 may detect degradation speeds of the pixels PX. For example, the timing controller 150 may detect degradation speeds by using sensing results of the sensor 140, e.g., the sensing data DS.

In an example embodiment, the look-up table LUT of the memory 160 may store a standard degradation profile indicating standard degradation degrees of the pixels PX. The standard degradation profile may indicate a value of the brightness "L" varying over the time "T" as indicated by the first line L1 or the second line L2 in FIG. 5.

The timing controller 150 may determine current degradation degree of each of the pixels PX on the standard degradation profile, by using first differences between the display data DD and the calibrated display data DD_C and second differences between original brightnesses corresponding to the display data DD and current brightnesses indicated by the sensing results.

A sum of each of the first differences and each of the second differences may indicate a degree to which the brightness of each of the pixels PX is degraded. For example, the sum of each of the first differences and each of the second differences may indicate a brightness degradation degree of each of the pixels PX. The timing controller 150 may determine a degradation degree of each of the pixels PX as a position on the time axis "T" in FIG. 5, based on the brightness degradation degree of each of the pixels PX.

In an example embodiment, the timing controller 150 may determine that a degradation speed of each of the pixels PX becomes slower as the degradation degree of each of the pixels PX moves to the left on the time axis "T". The timing controller 150 may determine that a degradation speed becomes faster as the degradation degree of each of the pixels PX moves to the right on the time axis "T".

As another example, the timing controller 150 may compare a current position and a previous position on the time axis "T" with regard to each of the pixels PX. As a difference between the current position and the previous position on the time axis "T" increases, the timing controller 150 may determine that the degradation speed of each of the pixels PX becomes faster. As the difference between the current position and the previous position on the time axis "T" decreases, the timing controller 150 may determine that the degradation speed of each of the pixels PX becomes slower.

For another example, the look-up table LUT may include degradation speeds according to the low-power mode or according to an application in the active mode. The timing controller 150 may receive additional information from an external host device together with the display data DD. The additional information may include information of the low-power mode or information of an application generating the display data DD. The timing controller 150 may detect degradations speeds of pixels based on the additional information and the look-up table LUT.

In operation S220, the timing controller 150 may adjust sensing periods or compensation periods of pixels based on degradation speeds of the pixels PX. In an example embodiment, as described with reference to FIGS. 3 to 6, the degradation speeds of the pixels PX may be detected based on locations of the pixels PX in the display device 100. The sensing periods and the compensation periods may be adjusted differently from each other based on the locations of the pixels PX in the display device 100.

Figure 8:
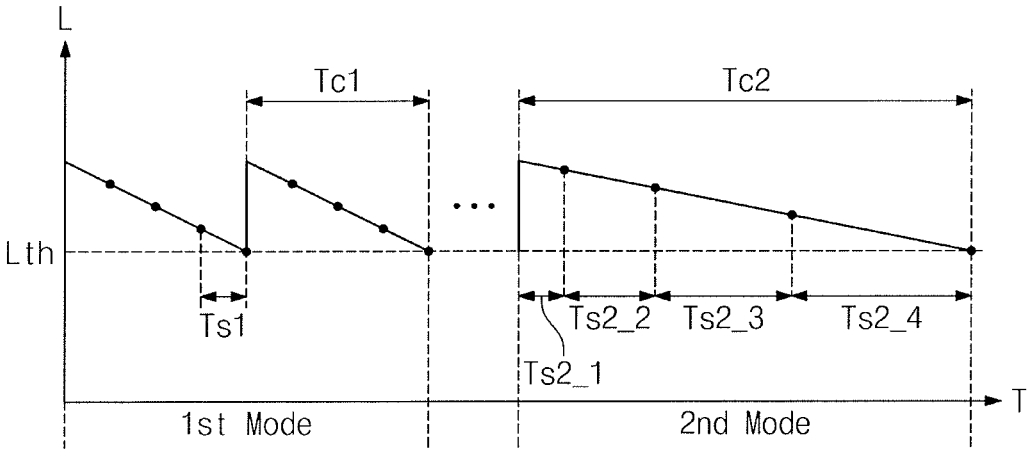
FIG. 8 illustrates an example in which a timing controller operates in a first mode and a second mode that have different sensing or compensation periods.

FIG. 8 illustrates an example in which the timing controller 150 operates in a first mode and a second mode that have different sensing or compensation periods. In FIG. 8, a horizontal axis represents the time "T", and a vertical axis represents the brightness "L" of a pixel. When degradation speeds of the pixels PX are faster than a reference speed, the timing controller 150 may operate in a first mode. When the degradation speeds of the pixels PX are slower than the reference speed, the timing controller 150 may operate in a second mode.

As the time "T" passes, the brightnesses "L" of the pixels PX may gradually decrease. In the first mode, the timing controller 150 may perform the sensing operation in a first sensing period Ts1. Dots in FIG. 8 may indicate timings when the sensing operations are performed. When the brightnesses "L" of the pixels PX reaches a threshold value Lth, the timing controller 150 may perform the compensation operation.

The timing controller 150 may adjust brightness values of the calibrated display data DD_C when the display data DD are converted into the calibrated display data DD_C. For example, the timing controller 150 may adjust internal calibration circuits so as to generate the calibrated display data DD_C by adding brightness values corresponding to the threshold value Lth to brightness values of the display data DD. The compensation operation in the first mode may be performed in a first compensation period Tel.

For example, degradation speeds of the pixels PX in the second mode may be slower than the degradation speeds of the pixels PX in the first mode. When brightnesses of the pixels PX are the threshold value Lth or greater, the timing controller 150 may gradually increase a second sensing period Ts2. For example, when the brightnesses of the pixels PX are the threshold value Lth or greater, the timing controller 150 may gradually decrease a sensing cycle of the sensing operation in the second mode. The compensation operation may be performed in a second sensing period Tc2 longer than the first compensation period Tel.

The power consumption of the display device 100 may be reduced by extending a sensing period or a compensation period when the degradation speeds of the pixels PX are slow. For example, the power consumption of the display device 100 may be reduced by increasing operating cycles of the sensing operation or the compensation operation when the degradation speeds of the pixels PX are slow. In an example embodiment, the timing controller 150 may perform the sensing and compensation operations on the pixels PX together in the first mode or the second mode. For another example, as described with reference to FIGS. 3 to 6, the timing controller 150 may perform the sensing operation and the compensation operation in the first mode and the second mode, respectively, according to different regions of the pixels PX.

In an example embodiment, the timing controller 150 may operate in three or more modes based on degradation speeds of pixels PX. For example, one mode may have a fixed sensing period. For example, other modes may have different sensing periods dynamically adjusted. Increments of the sensing periods in the other modes may be different.

Figure 9:
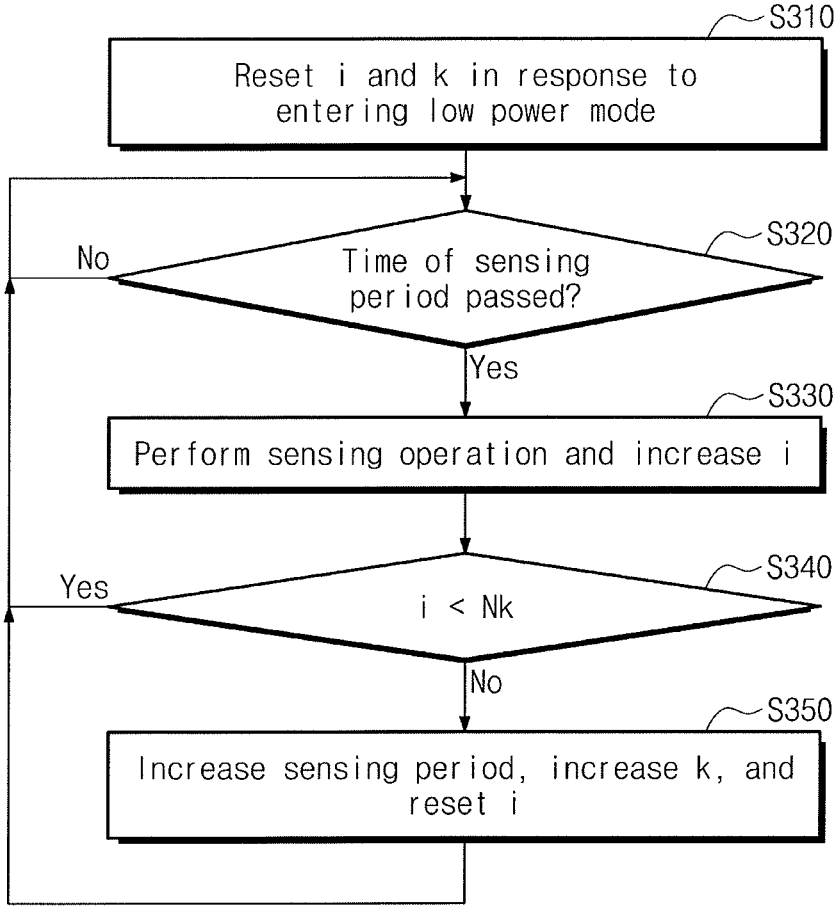
FIG. 9 illustrates another example in which a timing controller adjusts a sensing period in a second mode.

FIG. 9 illustrates another example in which the timing controller 150 adjusts a sensing period in a second mode. Referring to FIG. 9, brightnesses of the pixels PX may be the threshold value Lth or greater. In an example embodiment, the second mode may be the low-power mode, and the first mode may be the active mode. Alternatively, the second mode may be the active mode, and the first mode may be the low-power mode.

Referring to FIGS. 1, 8, and 9, in operation S310, the timing controller 150 may reset a variable "i" and a variable "j" to, e.g., "0" or a default value when the low-power mode is started. The timing controller 150 may detect the start of the low-power mode from additional information received from an external host device together with the display data DD.

In operation S320, the timing controller 150 may determine whether a time of a sensing period passes. For example, the timing controller 150 may detect whether the time of the sensing period passes after an immediately previously sensing operation is performed. The timing controller 150 may determine to perform a next sensing operation when the time of the sensing period passes after the immediately previously sensing operation is performed. Further, the timing controller 150 may wait without performing works associated with the next sensing operation and the compensation operation when the time of the sensing period does not pass.

In operation S330, the timing controller 150 may perform the sensing operation to increase the variable "i" when the timing controller 150 determines that the time of the sensing period passes. In operation S340, the timing controller 150 may determine whether the variable "i" is smaller than a constant Nk. The constant Nk may have a different value according to a value of "k". Values of the constant Nk may be included in the look-up table LUT.

When the variable "i" is smaller than the constant Nk, the timing controller 150 may perform the operation S320 repeatedly. When the variable "i" is not smaller than the constant Nk, operation S350 may be performed. In the operation S350, the timing controller 150 may increase the sensing period, increase the variable "k", and reset the variable "i".

For example, the timing controller 150 may adjust the number of times that the sensing operation is performed, which is necessary to increase the sensing period, based on the number of times that the sensing period increases. For example, N1 may be 2, and N2 may be 4. In the case where the sensing operation is performed two times at a default sensing period, because "i" is equal to "N1", the timing controller 150 may increase the sensing period. In the case where the sensing operation is performed four times at the increased sensing period, because "i" is equal to "N2", the timing controller 150 may further increase the sensing period.

Referring to FIG. 9, when the brightnesses "L" of the pixels PX become smaller than the threshold value Lth, the timing controller 150 may perform the compensation operation. When the compensation operation is performed, the timing controller 150 may maintain the values of the variables "i" and "j" and the sensing period, and may continue the process in FIG. 9. For another example, when the compensation operation is performed, the timing controller 150 may initialize the values of the variables "i" and "j" and the sensing period, and may again initiate the process in FIG. 9. Further, when the display device 100 exists from the low-power mode, the timing controller 150 may terminate the process in FIG. 9 and may enter the first mode.

Figure 10:
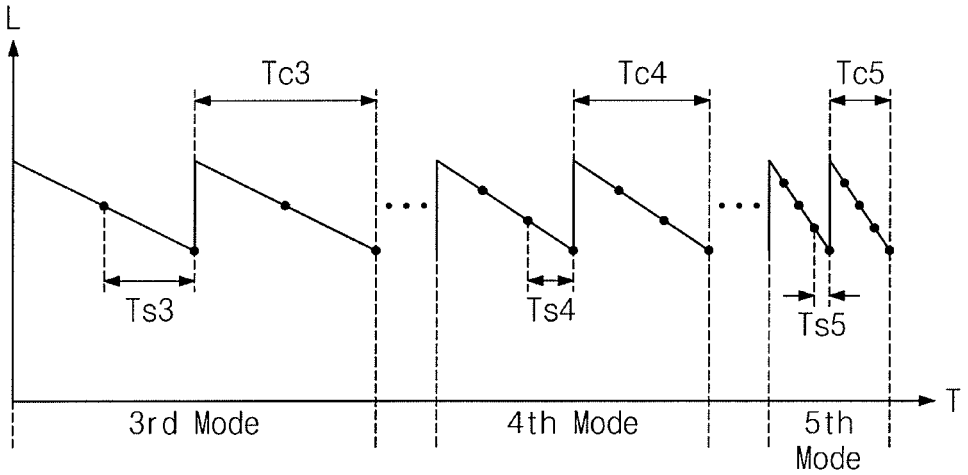
FIG. 10 illustrates an example in which a timing controller operates a third mode, a fourth mode, and a fifth mode that have different sensing or compensation periods.

FIG. 10 illustrates an example in which the timing controller 150 operates in a third mode, a fourth mode, and a fifth mode that have different sensing or compensation periods. Referring to FIGS. 1 and 10, when the degradation speeds of the pixels PX are slower than a first speed, the timing controller 150 may operate in the third mode. In the third mode, the timing controller 150 may perform the sensing operation in a third sensing period Ts3. For example, a length of the third sensing period Ts3 may be fixed. Each of dots in FIG. 10 may indicate each sensing operation.

The timing controller 150 may perform the compensation operation in a third compensation period Tc3 that is fixed. For example, the timing controller 150 may perform the compensation operation in the third compensation period Tc3 regardless of brightnesses of the pixels PX. In an example embodiment, the length of the third compensation period Tc3 may correspond to a total length of two sensing operations.

When the degradation speeds of the pixels PX are the first speed or higher and are slower than a second speed, the timing controller 150 may operate in the fourth mode. In the fourth mode, the timing controller 150 may operate in a fourth sensing period Ts4 and a fourth compensation period Tc4. For example, lengths of the fourth sensing period Ts4 and the fourth compensation period Tc4 may be fixed. In an example embodiment, the length of the fourth compensation period Tc4 may correspond to a total length of three sensing operations.

When the degradation speed of the pixels PX are the second speed, the timing controller 150 may operate in the fifth mode. In the fifth mode, the timing controller 150 may operate in a fifth sensing period Ts5 and a fifth compensation period Tc5. For example, lengths of the fifth sensing period Ts5 and the fifth compensation period Tc5 may be fixed. In an example embodiment, the length of the fifth compensation period Tc5 may correspond to a total length of four sensing operations.

Referring to FIG. 10, although the description is given as the timing controller 150 operates in the three operational modes, the number of the operational modes may be changed. Further, the timing controller 150 may be configured to adjust sensing periods and not to adjust compensation periods. Alternatively, the timing controller 150 may be configured not to adjust sensing periods and to adjust compensation periods.

Figure 11:
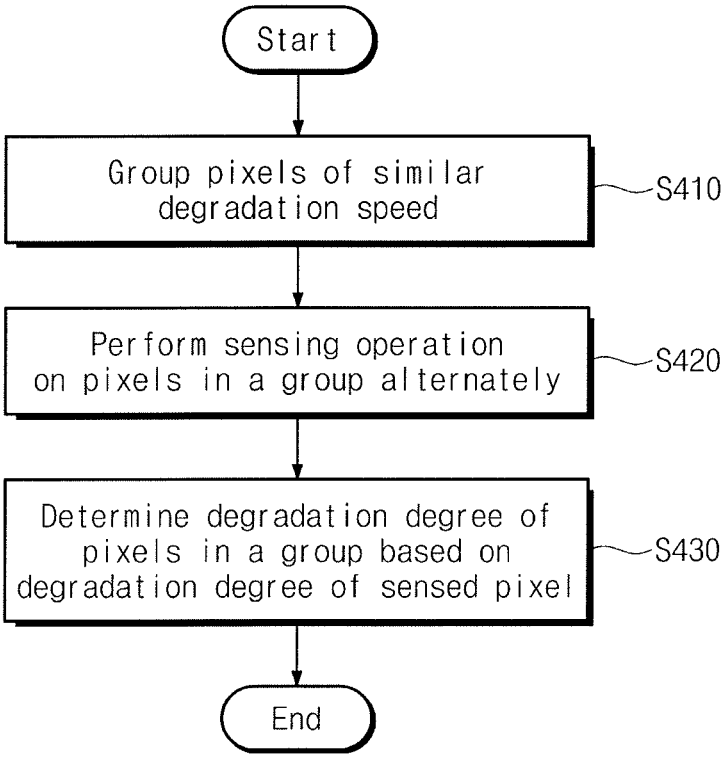
FIG. 11 illustrates a third example in which a timing controller adjusts a sensing period or a compensation period.

FIG. 11 illustrates a third example in which a timing controller adjusts a sensing period or a compensation period. Referring to FIGS. 1 and 11, in operation S410, the timing controller 150 may group pixels with similar degradation speeds. For example, the timing controller 150 may group pixels, the current degradation speeds of which are similar even though the pixels have the degrees of different degradation.

In operation S420, the timing controller 150 may alternately perform the sensing operation on the grouped pixels. For example, the timing controller 150 may select one or more pixels from the grouped pixels. When the sensing operation on the pixels PX is performed, the timing controller 150 may perform the sensing operation only on the selected one or more pixels of the grouped pixels.

In operation S430, the timing controller 150 may determine the degradation degrees of the grouped pixels, based on the degradation degree(s) of the sensed pixel(s). For example, when the brightness of a sensed pixel decreases as much as "x" (x being a positive number) compared with a brightness sensed in a previous sensing operation, the timing controller 150 may determine that brightnesses of all the grouped pixels decrease as much as "x".

A length of a sensing period of some pixels may increase by skipping sensing operations of some pixels. Thus, power consumption of the display device 100 may be reduced by increasing the length of the sensing period of the some pixels.

In an example embodiment, the timing controller 150 may release the grouping of the pixels periodically (e.g., by a period corresponding to several frames). When the grouping of the pixels is released, a sensing operation may be performed on each of the pixels PX. Thus, the sensing operation may be performed on pixels, which are skipped from the sensing operation when the pixels are grouped, to obtain the degradation degrees thereof. Further, pixels with similar degradation degrees may be determined based on the obtained degradation degrees of the pixels.

Figure 12:
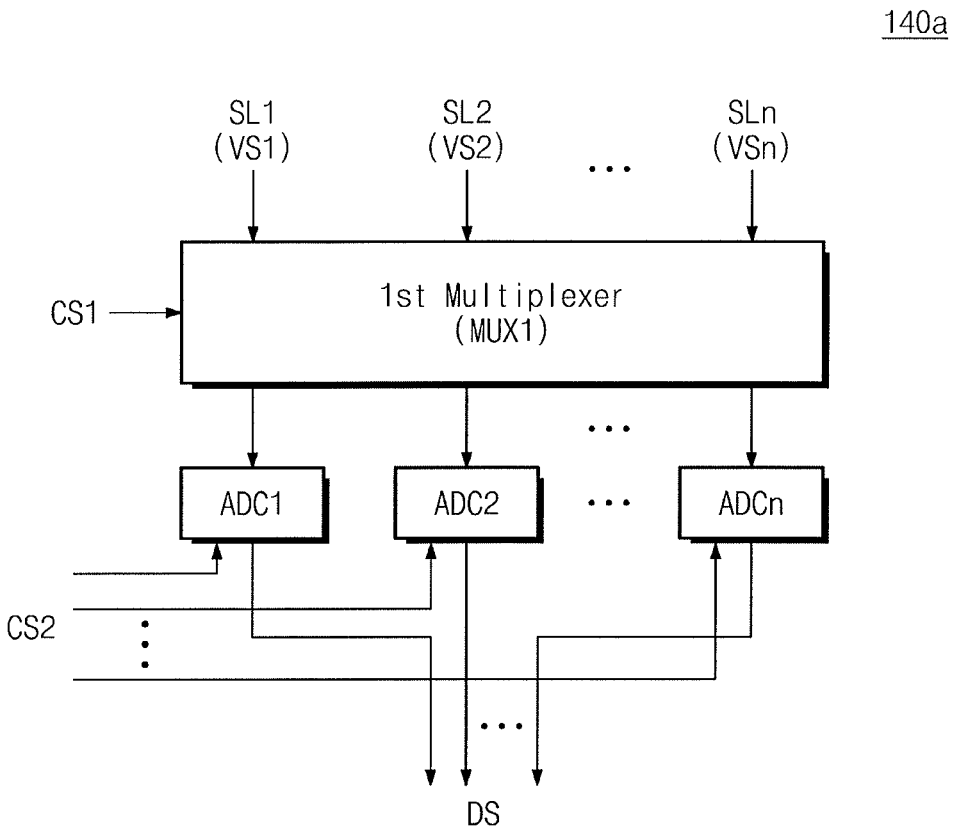
FIG. 12 illustrates a sensor according to a first example for grouping pixels.

FIG. 12 illustrates a sensor 140*a* according to a first example for grouping the pixels PX. Referring to FIGS. 1 and 12, the sensor 140*a* may include a first multiplexer MUX1 and first to n-th analog-to-digital converters ADC1 to ADCn. The first multiplexer MUX1 may receive sensing voltages VS through the sensing line SL. For example, the sensing voltage VS may include first to n-th sensing voltages VS1. For example, the sensing lines SL may include first to n-th sensing lines SL1 to SLn.

The first multiplexer MUX1 may operate in response to a first control signal CS1. The first control signal CS1 may be included in the control signal CS provided from the timing controller 150. The first multiplexer MUX1 may adjust paths for transferring the first to n-th sensing voltages VS1 to VSn to the first to n-th analog-to-digital converters ADC1 to ADCn.

For example, when the first to n-th sensing voltages VS1 to VSn are associated with pixels that do not belong to one group, the first multiplexer MUX1 may transfer the first to n-th sensing voltages VS1 to VSn to the first to n-th analog-to-digital converters ADC1 to ADCn, respectively.

The first to n-th analog-to-digital converters ADC1 to ADCn may be activated in response to a second control signal CS2. The second control signal CS2 may be included in the control signal CS provided from the timing controller 150. The first to n-th analog-to-digital converters ADC1 to ADCn may digitize the first to n-th sensing voltages VS1 to VSn and may output digitized results as the sensing data DS.

When the first to n-th sensing voltages VS1 to VSn are associated with pixels that belong to one group, the first sensing voltage VS1 and the second sensing voltage VS2 may be alternately sensed. The first multiplexer MUX1 may transfer the first sensing voltage VS1 and the second sensing voltage VS2, which are alternately sensed, to one selected analog-to-digital converter (e.g., ADC1 or ADC2).

The other unselected analog-to-digital converter (e.g., ADC2 or ADC1) may be deactivated in response to the second enable signal CS2. As one analog-to-digital converter is maintained in an active state, mismatches among analog-to-digital converters may not be considered. For example, when a plurality of analog-to-digital converters are used for performing the sensing operations, offsets among the plurality of analog-to-digital converters may be caused by changing bias currents thereof and may be adjusted.

Further, when a sensing operation is performed by using each of the first to n-th sensing lines SL1 to SLn, the first multiplexer MUX1 may control transferring the first to n-th sensing voltages VS1 to VSn to a part of the first to n-th analog-to-digital converters ADC1 to ADCn in a time-division manner. The timing controller 150 may control the sensor 140*a* such that sensing voltages corresponding to two or more pixels are processed by one analog-to-digital converter in the time-division manner.

For example, the first multiplexer MUX1 may transfer sensing voltages of odd-numbered sensing lines to odd-numbered analog-to-digital converters and may then transfer sensing voltages of even-numbered sensing lines to the odd-numbered analog-to-digital converters. Alternatively, the first multiplexer MUX1 may transfer the sensing voltages of the odd-numbered sensing lines to even-numbered analog-to-digital converters and may then transfer the sensing voltages of the even-numbered sensing lines to the even-numbered analog-to-digital converters. As only a part of analog-to-digital converters is activated, power consumption of the display device 100 may be further reduced.

Figure 13:
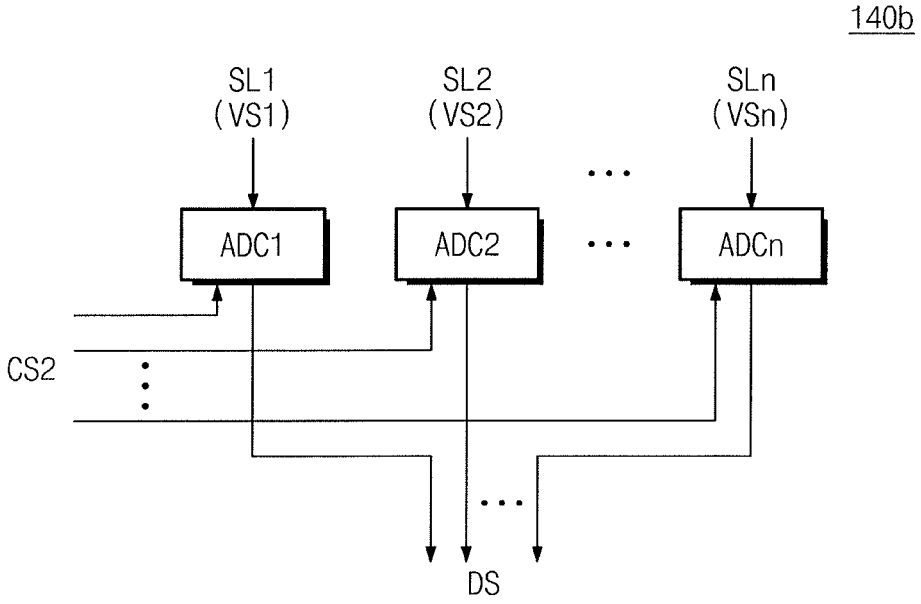
FIG. 13 illustrates a sensor according to a second example for grouping pixels.

FIG. 13 illustrates a sensor 140*b* according to a second example for grouping the pixels PX. Compared to FIG. 12, the sensor 140*b* does not include the first multiplexer MUX1. For example, the first to n-th sensing lines SL1 to SLn may be directly connected to the first to n-th analog-to-digital converters ADC1 to ADCn.

When a sensing operation of a particular pixel is skipped through grouping of pixels, the timing controller 150 may deactivate an analog-to-digital converter corresponding to the particular pixel through the second control signal CS2. For example, the first multiplexer MUX1 may be removed when a space for the sensor 140*b* is limited.

Figure 14:
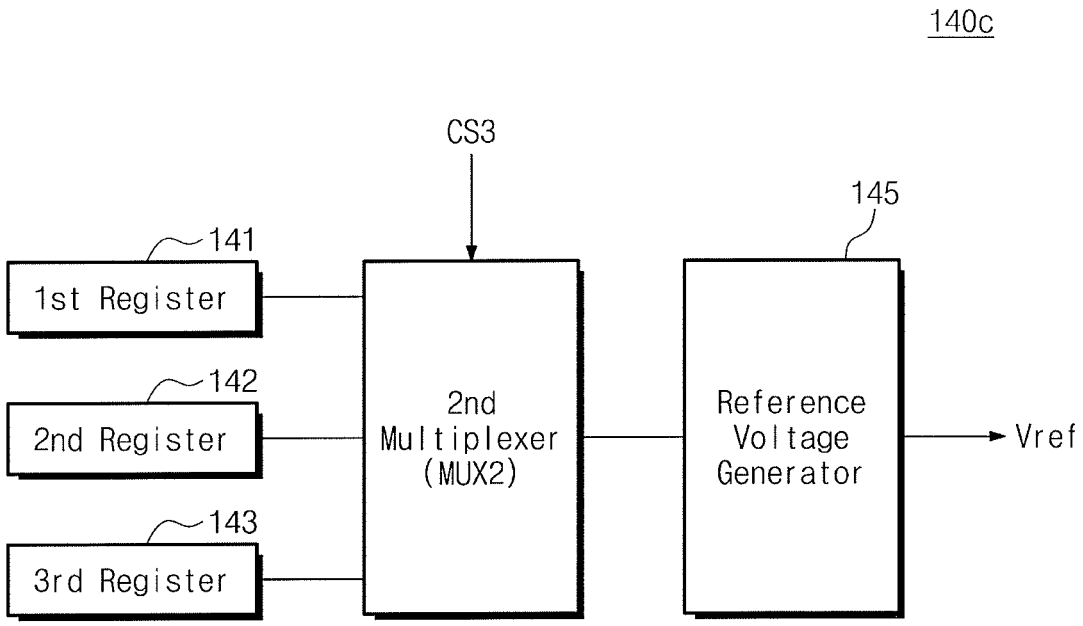
FIG. 14 illustrates a sensor according to a third example for grouping pixels.

FIG. 14 illustrates a sensor 140*c* according to a third example for grouping the pixels PX. Referring to FIGS. 1 and 14, the sensor 140*c* may include first to third registers 141 to 143, a second multiplexer MUX2, and a reference voltage generator 145.

The first to third registers 141 to 143 may store different register values. The second multiplexer MUX2 may select one of the first to third registers 141 to 143 in response to a third control signal CS3. The third control signal CS3 may be included in the control signal CS provided from the timing controller 150.

The reference voltage generator 145 may generate a reference voltage Vref by using a register value selected by the second multiplexer MUX2. The reference voltage Vref may be used for the first to n-th analog-to-digital converters ADC1 to ADCn in FIG. 12 or 13 to convert all or a part of the first to n-th sensing voltages VS1 to VSn into the sensing data DS.

As the number of analog-to-digital converts activated in the sensor 140*a* or 140*b* changes, power consumption of the sensor 140*a* or 140*b* may change. As the power consumption of the sensor 140*a* or 140*b* changes, a level of the reference voltage Vref may change. A change in the reference voltage Vref may be compensated by selecting a register for generating the reference voltage Vref from the first to third registers 141 to 143.

Figure 15:
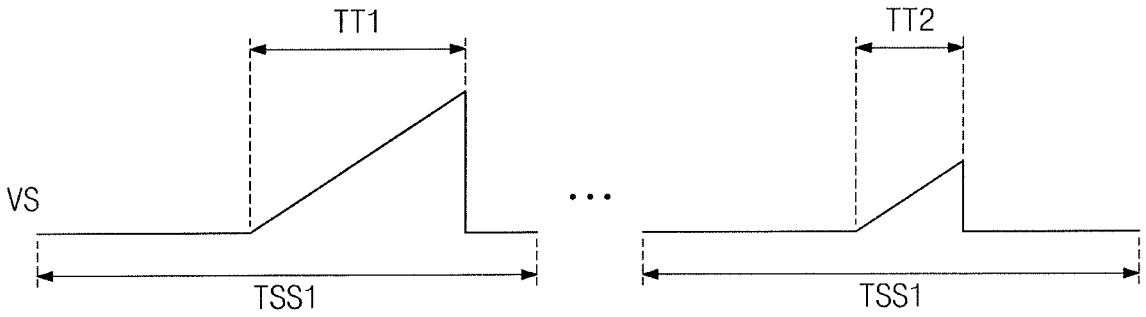
FIG. 15 illustrates a sixth mode of a fourth example in which a timing controller adjusts a sensing period or a compensation period.
Figure 16:
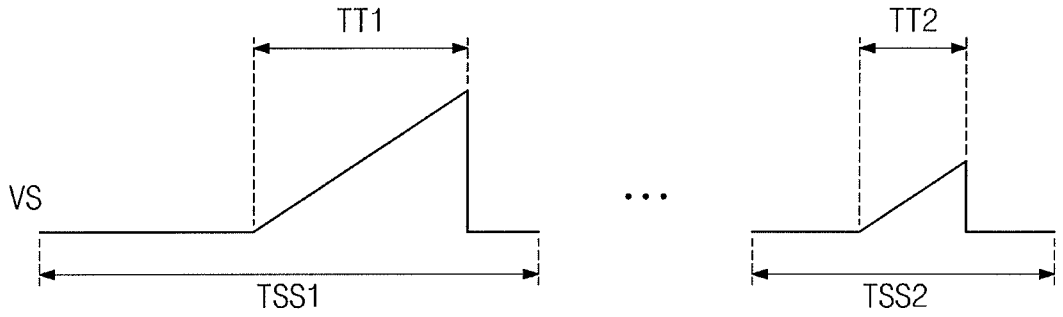
FIG. 16 illustrates a seventh mode of a fourth example in which a timing controller adjusts a sensing period or a compensation period.

FIGS. 15 and 16 illustrate a fourth example in which the timing controller 150 adjusts a sensing period or a compensation period. FIG. 15 illustrates a sixth mode of the fourth example in which the timing controller 150 adjusts a sensing period or a compensation period. Referring to FIGS. 1 and 15, the timing controller 150 may maintain a sensing time of a sensing operation for pixels in one row in a first sensing time TSS1.

The timing controller 150 may change a transfer time when information of brightnesses of pixels in one row is transferred to the sensing lines SL, to a first transfer time TT1 and a second transfer time TT2. For example, the look-up table LUT may store information of locations of pixels robust to a noise. The timing controller 150 may read the look-up table LUT and may decrease a transfer time to the second transfer time TT2 when performing a sensing operation for the pixels robust to the noise.

The timing controller 150 may use the first transfer time TT1 when a sensing operation is performed on pixels that are not robust to a noise. Power consumption of the display device 100 may be reduced by decreasing a transfer time associated with some pixels.

FIG. 16 illustrates a seventh mode of the fourth example in which the timing controller 150 adjusts a sensing period or a compensation period. Comparing to FIG. 15, when a transfer time is decreased from the first transfer time TT1 to the second transfer time TT2, the timing controller 150 may also decrease a sensing time from the first sensing time TSS1 to a second sensing time TSS2.

In particular, in the embodiment associated with FIGS. 1 and 12, when the first multiplexer MUX1 deactivates a part of the first to n-th analog-to-digital converters ADC1 to ADCn in a time-division manner, activated analog-to-digital converters may perform conversion two times or more.

For example, a sensing operation may be performed on a particular row among rows of the pixels PX two times or more, thus causing an increase in a total of sensing time of the particular row. However, when the seventh mode in FIG. 16 is applied to sensing operation, a sensing time may be decreased. Thus, an increase in a total of sensing time due to a time-division-based sensing operation may be compensated.

In the above embodiment, the description is given as the timing controller 150 receives the sensing data DS and directly performs a sensing operation and a compensation operation. Further, the timing controller 150 may transmit the sensing data DS to an external host device (e.g., an AP or a GPU). The timing controller 150 may receive levels for calibration from the external host device.

For example, the external host device may control the sensing operation and the compensation operation. To implement the embodiments described with reference to FIGS. 1 to 16, the timing controller 150 may be configured to communicate with the external host device and to convert the display data DD into the calibrated display data DD_C.

In FIGS. 15 and 16, the description is given as the sensing voltage VS increases. The sensor 140 may be configured to integrate or accumulate the sensing voltage VS. As the sensor 140 may be implemented to integrate or accumulate the sensing voltage VS, the sensing voltage VS may be integrated or accumulated to an increasing waveform or a decreasing waveform.

As described above, components of the display device 100 are described by using the terms "first", "second", "third", and the like. However, the terms "first", "second", "third", and the like may be used to distinguish components from each other. For example, the terms "first", "second", "third", and the like do not involve an order or a numerical meaning of any form.

In the above embodiments, components according to embodiments may be implemented with various hardware devices, e.g., an integrated circuit, an application specific IC (ASCI), a field programmable gate array (FPGA), and a complex programmable logic device (CPLD), firmware driven in hardware devices, software such as an application, or a combination of a hardware device and software. Also, the components may include circuits enrolled as circuits or intellectual property (IP) blocks implemented with semiconductor elements in an integrated circuit.

Various operations of methods described above may be performed as is suitable, such as by various hardware and/or software components, modules, and/or circuits. When implemented in software, the operations may be implemented using, for example, an ordered listing of executable instructions for implementing logical functions, and may be embodied in a processor-readable medium for use by or in connection with an instruction execution system, apparatus, or device, such as a single or multiple-core processor or processor-containing system.

In some embodiments, blocks or steps of a method or algorithm and functions described in connection with the embodiments disclosed herein may be embodied directly in hardware, in a software module executed by a processor, or in a combination of software and hardware. If implemented in software, the functions may be stored on or transmitted over as one or more instructions or code on a tangible, non-transitory computer-readable medium. A software module may reside in, for example, Random Access Memory (RAM), flash memory, Read Only Memory (ROM), Electrically Programmable ROM (EPROM), Electrically Erasable Programmable ROM (EEPROM), registers, hard disk, a removable disk, a CD ROM, or any other suitable form of storage medium.

According to embodiments, a sensing period of a sensing operation and a compensation period of a compensation operation may be adjusted to reduce power consumption. Also, the degradation degrees of pixels having similar degradation speeds may be alternately measured, and thus, power consumption may be reduced. A transfer time when voltages or currents including degradation information are transferred from pixels to sensing lines, may be adjusted to reduce power consumption. There may be provided a display device reducing the amount of power necessary for a sensing operation by adjusting time parameters associated with the sensing operation.

Example embodiments have been disclosed herein, and although specific terms are employed, they are used and are to be interpreted in a generic and descriptive sense only and not for purpose of limitation. In some instances, as would be apparent to one of ordinary skill in the art as of the filing of the present application, features, characteristics, and/or elements described in connection with a particular embodiment may be used singly or in combination with features, characteristics, and/or elements described in connection with other embodiments unless otherwise specifically indicated. Accordingly, it will be understood by those of skill in the art that various changes in form and details may be made without departing from the spirit and scope of the present invention as set forth in the following claims.

What is claimed is:

1. A display device, comprising:

a display panel including pixels in rows and columns;

a gate driver connected to the pixels in the rows through first gate lines and second gate lines;

a data driver connected to the pixels in the columns through data lines;

a sensor connected to the pixels in the columns through sensing lines;

a memory to store a look-up table including information of brightnesses of the pixels; and a timing controller to control the gate driver and the data driver to adjust the brightnesses of the pixels through the first gate lines and the data lines and to control the gate driver and the sensor to perform a sensing operation for sensing the brightnesses of the pixels through the second gate lines and the sensing lines, wherein the timing controller is further to read the look-up table from the memory, detect degradation speeds of the pixels, and to adjust a sensing period of the sensing operation based on the look-up table and the degradation speeds of the pixels.

2. The display device as claimed in claim 1, wherein the information of brightnesses of the pixels includes first information of first brightnesses of first pixels among the pixels and second information of second brightnesses of second pixels among the pixels, and wherein, based on the first information and the second information, the timing controller adjusts a first sensing period of the first pixels and a second sensing period of the second pixels differently.

3. The display device as claimed in claim 1, wherein when the brightnesses of the pixels indicated by a sensing result of the sensing operation are a threshold brightness or higher, the timing controller increases the sensing period.

4. The display device as claimed in claim 1, wherein when the brightnesses of the pixels indicated by a sensing result of the sensing operation are lower than a threshold brightness, the timing controller decreases the sensing period.

5. The display device as claimed in claim 4, wherein when the brightnesses of the pixels indicated by a sensing result of the sensing operation are lower than the threshold brightness, the timing controller controls the data driver to perform a compensation operation for compensating the brightnesses of the pixels.

6. The display device as claimed in claim 1, wherein the timing controller operates in a first mode and a second mode, and wherein:

in the second mode, the timing controller adjusts the sensing period based on the look-up table and the degradation speeds of the pixels, and in the first mode, the timing controller maintains the sensing period to be constant.

7. The display device as claimed in claim 6, wherein the timing controller operates in the first mode when the degradation speeds of the pixels correspond to a first speed; and wherein the timing controller operates in the second mode when the degradation speeds of the pixels correspond to a second speed slower than the first speed.

8. The display device as claimed in claim 1, wherein the timing controller operates in a first mode and a second mode, and wherein:

in the first mode, the timing controller adjusts the sensing period to a first period, and in the second mode, the timing controller adjusts the sensing period to a second period shorter than the first period.

9. The display device as claimed in claim 8, wherein the timing controller operates in the first mode when the degradation speeds of the pixels correspond to a first speed; and wherein the timing controller operates in the second mode when the degradation speeds of the pixels correspond to a second speed slower than the first speed.

10. The display device as claimed in claim 1, wherein the timing controller is further to:

receive mode information indicating a power saving mode or an active mode from an external host device; and detect the degradation speeds of the pixels based on the mode information.

11. The display device as claimed in claim 1, wherein the timing controller receives display data from an external host device and controls the data driver to adjust voltages of the data lines based on the display data, and wherein the timing controller is further to:

receive application information of an application generating the display data, from the external host device; and detect the degradation speeds of the pixels based on the application information.

12. The display device as claimed in claim 1, wherein the timing controller is further to:

receive a sensing result of the sensing operation from the sensor; and detect the degradation speeds of the pixels based on the sensing result and the look-up table.

13. The display device as claimed in claim 1, wherein the timing controller receives a sensing result of the sensing operation from the sensor and controls the data driver to perform a compensating operation for compensating the brightnesses of the pixels when the brightnesses of the pixels are lower than a threshold brightness.

14. The display device as claimed in claim 1, wherein, when the sensing operation is performed as much as a compensation period after the brightnesses of the pixels are compensated, the timing controller controls the data driver to perform a compensation operation for compensating the brightnesses of the pixels, and wherein the timing controller is further to adjust the compensation period based on the look-up table.

15. A display device, comprising:

a display panel including pixels arranged in rows and columns;

a gate driver connected to the pixels in the rows through first gate lines and second gate lines;

a data driver connected to the pixels in the columns through data lines;

a sensor connected to the pixels in the columns through sensing lines; and a timing controller to control the gate driver and the data driver to control brightnesses of the pixels through the first gate lines and the data lines and to control the gate driver and the sensor to perform a sensing operation for sensing the brightnesses of the pixels through the second gate lines and the sensing lines, wherein the timing controller is further to:

receive a sensing result of the sensing operation from the sensor;

detect degradation speeds of the pixels based on the sensing result; and set similar degradation pixels, which have similar degradation speeds, from among the pixels to a pixel group, and in the sensing operation, select one pixel from the similar degradation pixels belonging to the pixel group;

sense a brightness of the selected one pixel;

detect a degradation speed of the selected one pixel; and determine the degradation speed as the similar degradation speeds of the similar degradation pixels, and wherein the timing controller is further to read a look-up table including information of the brightnesses of the pixels, and adjust a sensing period of the sensing operation based on the look-up table and the degradation speeds of the pixels.

16. The display device as claimed in claim 15, wherein the timing controller is further to:

alternately select one pixel from among the similar degradation pixels as the one pixel; and release the pixel group when a trend in the degradation speed of the alternately selected one pixel changes.

17. The display device as claimed in claim 15, wherein the timing controller is further to release the pixel group when the sensing operation of the selected one pixel is performed as much as a check period.

18. A display device, comprising:

a display panel including pixels arranged in rows and columns;

a gate driver connected to the pixels in the rows through first gate lines and second gate lines;

a data driver connected to the pixels in the columns through data lines;

a sensor connected to the pixels in the columns through sensing lines; and a timing controller to control the gate driver and the data driver to adjust brightnesses of the pixels through the first gate lines and the data lines and to control the gate driver and the sensor to perform a sensing operation for sensing the brightnesses of the pixels through the second gate lines and the sensing lines, wherein the timing controller is further to adjust a transfer time when voltages are transferred from pixels in each of the rows of the pixels to the sensing lines in the sensing operation, and wherein the timing controller is further to adjust the transfer time while maintaining a sensing time allocated to the pixels in each row in a first mode and to adjust the sensing time and the transfer time together in a second mode.

* * * * *